US006007377A

United States Patent [19]

Cook

[11] Patent Number: 6,007,377

[45] Date of Patent: Dec. 28, 1999

[54] IN LINE REWIRABLE SWITCH DEVICE

[75] Inventor: David Langman Cook, Rangiora, New Zealand

[73] Assignee: PDL Holdings Limited, Christchurch, New Zealand

[21] Appl. No.: 09/027,073

[22] Filed: Feb. 20, 1998

[30] Foreign Application Priority Data

Feb. 20, 1997 [NZ] New Zealand ..... 314278

[51] Int. Cl.[6] ..... H01R 13/40

[52] U.S. Cl. ..... 439/587; 174/77 R

[58] Field of Search ..... 439/587, 589, 439/731; 200/302.2; 174/91, 92, 93, 77 R, 50.5

[56] References Cited

U.S. PATENT DOCUMENTS

| | | | |
|---|---|---|---|
| 4,567,544 | 1/1986 | Ronemus et al. | 361/399 |
| 4,742,199 | 5/1988 | Andis et al. | 200/302.1 |
| 4,839,483 | 6/1989 | Doyle | 200/302.1 |
| 4,958,256 | 9/1990 | Parkhomenko et al. | 361/331 |
| 5,568,344 | 10/1996 | Gernhardt et al. | 361/42 |

FOREIGN PATENT DOCUMENTS 975025 2/1951 France .

*Primary Examiner*—Khiem Nguyen
*Assistant Examiner*—T C Patel
*Attorney, Agent, or Firm*—Ladas & Parry

[57] ABSTRACT

An in line switch device (1) includes a switch housing (3, 4) providing a switch component chamber. A switch actuator (8, 9) is operable from the exterior of the switch housing (3, 4). At least two sets of switch terminals (17, 18, 19, 20, 21, 22) are accessible from the exterior of the switch component chamber and are covered by a removable closure or respective removable closures (26, 27). The removable closure(s) has two cable apertures (28) for passage of respective power cables to be connected to respective sets of switch terminals (17, 18, 19, 20, 21, 22). A first sealing device (29, 30) is associated with each cable aperture (28) for sealing around the associated power cable. The removable closure(s) (26, 27) are engaged with the switch housing (3, 4) with one or more second sealing devices (14, 15) provided at the interface between the or each removable closure (26, 27) and the housing (3, 4). The switch (3, 4) is sealed, at least externally of the closure(s) (26, 27) to protect against the ingress of moisture into the switch component chamber.

6 Claims, 2 Drawing Sheets

IN LINE REWIRABLE SWITCH DEVICE

BACKGROUND OF THE INVENTION

This invention relates to an in line rewirable switch. In particular the present invention relates to an in line rewirable residual current ("RCD") device.

There is an increasing requirement for safety devices to be provided with electrical appliances. These safety devices can be residual current devices built into or attached to the power outlet supplying the appliance. It is however preferable that the safety devices are incorporated into the appliance itself or in the power supply cable to the appliance since the closer the safety device is to the appliance, the sooner earth leakage will be detected.

It is known to incorporate safety devices within an electrical power supply cord. Such units generally comprise a switch housing with the switch components and the terminals for connection to the two intermediate ends of the power supply cord contained within the housing. The remainder of the internal space within the housing is filled with a sealing compound to prevent against the ingress of moisture into the housing. It will be appreciated that various forms of electrical power supply cords and plugs will be required to meet the requirements of a number of countries. However, the conventional units are sealed and cannot easily be rewired to change the electrical power supply cords. The disadvantage therefore, for a manufacturer of conventional units is the need to produce a range of different units to meet the requirements of all the countries in which the units are to be sold.

SUMMARY OF THE INVENTION

It is an object of the present invention to provide an in line rewirable switch device which will overcome or at least ameliorate the abovementioned disadvantage or at least provide a useful choice over switch devices already on the market.

In accordance with a first aspect of the present invention, there is provided an in line switch device including: a switch housing providing a switch component chamber; a switch actuator operable from the exterior of the switch housing; a least two sets of switch terminals, each set for connection to a respective power cable, the sets of switch terminals being accessible for connection from the exterior of the switch component chamber and covered by a removable closure or respective removable closures, the removable closure(s) having at least two cable apertures for passage of respective power cables, a first sealing device associated with each cable aperture for sealing around the associated power cable, the removable closure(s) being engaged with the switch housing with one or more second sealing devices provided at the interface between the or each removable closure and the housing to enclose the terminals in a protected environment; wherein the switch housing is scaled, at least externally of the closure(s) to protect against the ingress of moisture into the switch component chamber.

There may be one or more closures providing the protected environment about the terminals. Preferably, the two closures are provided in the form of two end caps disposed at opposite ends of the switch housing in which case, the two cable apertures would suitably be provided in respective end caps. Further, the second sealing devices may be in the form of two seal rings, each seal ring being provided along the interface between a respective end cap and the housing. In a most preferred form of the invention, the two sealing rings are interconnected.

The switch housing may be of any form and the substantially waterproof sealing may achieved by any conventional manner. One preferred form of housing is a two-part housing which includes a top switch cover and a bottom switch cover. The sealing of the switch housing may be in the form of sealing strips engageable between the external joints of the top and bottom switch covers. In a particularly desirable form of the invention, the sealing strips interconnect the seal rings provided at opposite ends of the housing. The seal rings may be effective to releasably hold the top and bottom switch covers together in assembled configuration prior to securement with screws.

The switch housing may also incorporate at least one switch aperture through which the sealed switch actuator protrudes, the switch actuator being scaled to protect against the ingress of moisture into the switch chamber. One manner of achieving this is providing the switch actuator in the form of a resilient rubber button having peripheral flanges sealing against the underside of the surround about the switch aperture.

As previously mentioned, apertures are provided in the closure(s) for passage of the power cable. These apertures may be aligned so that the in line switch device assembled with power cables attached to the terminals forms a compact and streamlined unit.

Preferably the end caps support a cable grip to grip the attached power cable.

Preferably the switch device is an RCD.

In a further aspect the invention includes in a method of assembling an in line switch, said method comprising the steps of locating in an operative position, switch device components within a switch housing which when assembled defines a switch chamber, placing ring seals in respective sealing seats about each end of the housing with the ring seals holding the housing and contained components in place ready for placement of fixing means, with wiring terminals for the switch accessible from the exterior of the housing and within the confines of said ring seals, such that in use, when closures are engaged with respective ones of the ring seals, the terminals are provided in a protected environment and sealing the housing at least externally of the closures.

This invention may also be said broadly to consist in the parts, elements and features referred to or indicated in the specification of the application, individually or collectively, and any or all combinations of any two or more said parts, elements or features, and where specific integers arc mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWING

One preferred form of the invention will now be described with reference to the accompanying drawings in which.

DESCRIPTION OF EMBODIMENTS

The present invention is concerned with an in line rewirable switch device and is primarily designed to allow a residual current device to be wired into a power supply cable (not shown). If other types of switching devices are required in the cable they could be provided in this way but it is predominantly intended to ensure that a protection device can be included in a power cable. The present invention also relates to an assembly technique using the end sealing rings developed allowing the switch components to be held in place within the assembled switch housing ready for placement of the fixing means.

The in line rewirable RCD device 1 is a residual current device 2 (see FIG. 2) with an operating mechanism for example as disclosed and claimed in our New Zealand Patent Specification No. 293076/242376. It will be understood however that this is not an essential feature of the present invention and any RCD mechanism or for that matter any protective device or switching mechanism could be incorporated with the in line rewirable device according to the present invention.

Figure 1:
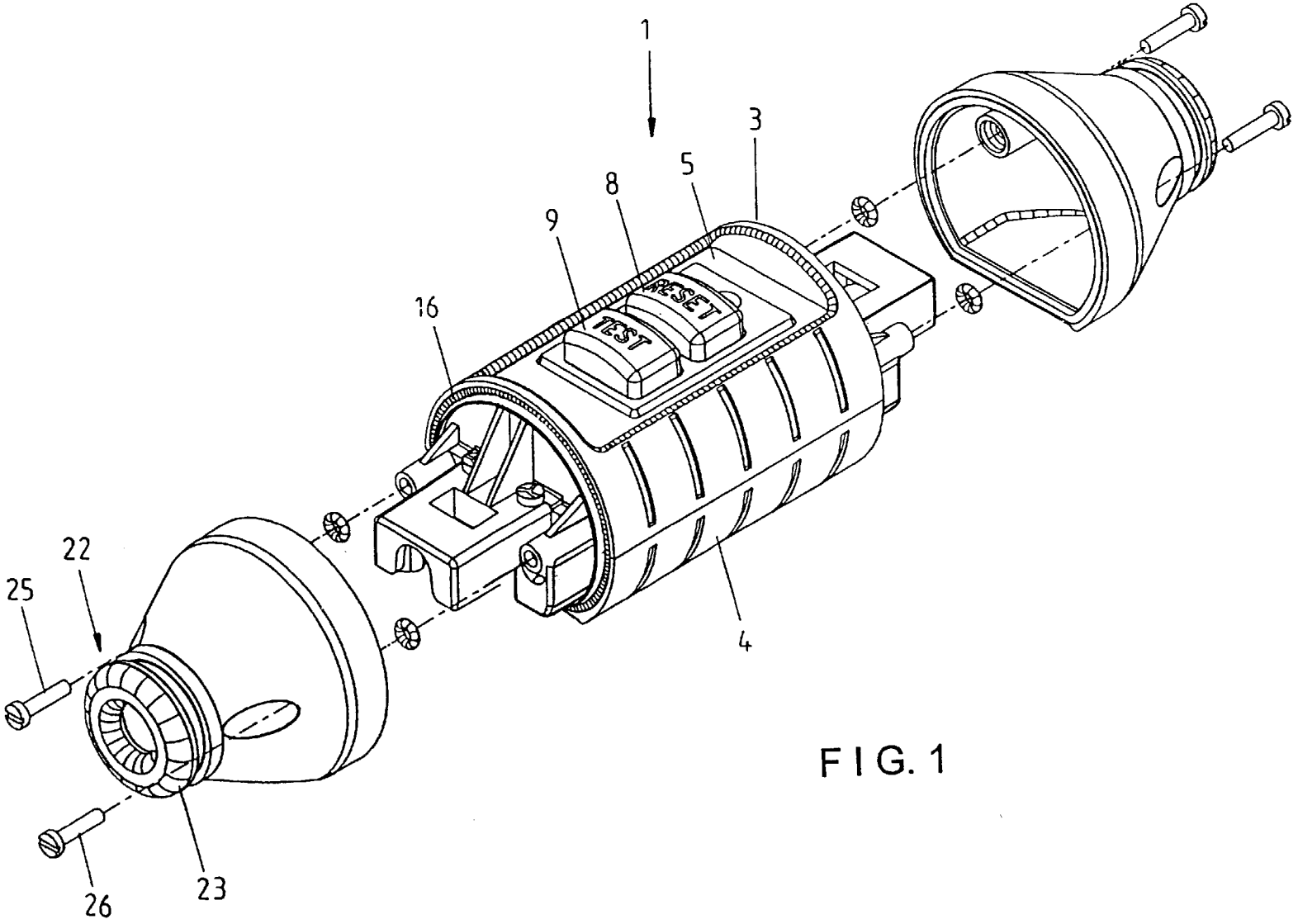
FIG. 1 is a perspective view of an in line rewirable residual current device showing the end caps in an exploded position.

As shown in FIG. 1, the in line rewirable RCD device 1 has a switch housing including a top switch cover 3 and a bottom switch cover 4 which in use can be assembled together to define a switch chamber to receive the RCD 2. The top cover 3 has a recessed section 5 with apertures 6 and 7 through which project the sealed reset switch button 8 and the test switch button 9 for the RCD unit 2. The buttons 8 and 9 are held in place by a plate 10 which allows the RCD control buttons to be operated while preserving the protected environment within the switch chamber.

Figure 2:
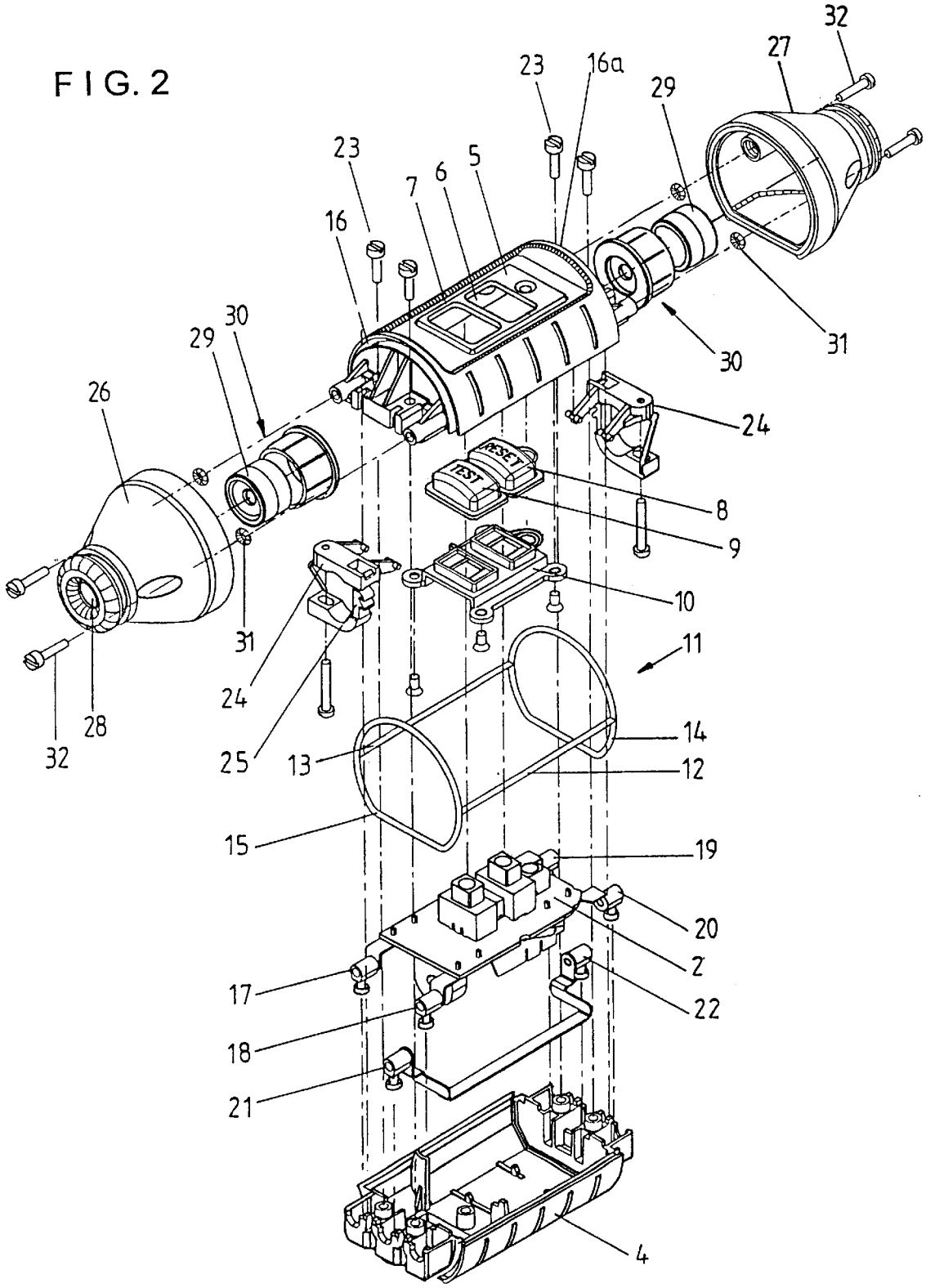
FIG. 2 is an exploded perspective view of a slightly modified form of the in line rewirable residual current device shown in FIG. 1.

As shown in FIG. 2, a seal 11 is provided having two sealing strips 12 and 13 which engage with the abutting external joints of the top and bottom switch covers and end rings 14 and 15 which engage in respective sealing seats 16, 16*a* about the assembled ends of the top and bottom switch covers. In line terminals 17, 18, 19 and 20 allow for the connection of the RCD device, to the intermediate ends of a power cable (not shown) with terminals 21 and 22 providing the earth connection.

These components are all arranged so that when the components are bought together, the seal rings 14 and 15 in respective end sealing seats 16 hold the components in place until the fixing screws 23 may be inserted. This provides a convenient and easy means of assembly. The terminals are in a position accessible from the ends of the housing to allow for the electrical connection to be made but within the confines of the sealing rings 14 or 15.

Each of a pair of cable grips 24 may be attached to respective ends of the top switch cover 3. The cable grips 24 each include an opening through which the associated cable extends. The cable grips each include a barbed portion to lock within a cooperating aperture on one side and a fastener on the other side to close the opening and hence clamp the cable. The two arms projecting from the cable grips 24 are attached to the housing by being held between the top and bottom switch covers 3,4. The design of the cable grips allows for slight pivotal movement.

Closures in the form of end caps 26 and 27 each have an axial aperture 28 extending therethrough. The axial aperture 28 has a first sealing device in the form of a sealing grommet 29 and seal cap 30 to provide a seal about the cable at the passage of the cable through the aperture 28. Sealing rings 31 are also provided for the attachment screws 32 so that when the end caps are fixed in place having an electric power cable passing therethrough and electrically connected to the terminals, a protected environment is provided for the terminals.

From the foregoing description it will be seen that the RCD 2 and other components may be assembled in place within the switch chamber and the top and bottom switch covers 3 and 4 brought together and held in position by the seal rings 14 and 15. The fixing screws can then be inserted. The end caps are secured to respective ends of the top and bottom switch covers but are removable therefrom which facilitates ready assembly of a completed unit including the power cables.

The end caps are provided with appropriate sealing devices for the power supply cable so that in use the end caps can be removed and a cable, appropriate to meet the requirements of the particular country concerned's power supply, can be inserted through the apertures 28 and the sealing devices 29 and 30 to be terminated on the terminals of the RCD. When the electrical connection is complete and each cable is held by the cable grip 24 and the sealing devices 29, 30 are in place, the end caps can be engaged with the body of the device and the sealing rings 15 or 14 to ensure there is a protected environment for the terminals.

What is claimed is:

1. An in line switch device including:

a switch housing providing a switch component chamber;

a switch actuator operable from the exterior of the switch housing;

two sets of switch terminals disposed at opposite ends of the switch housing for connection to respective power cables, the sets of switch terminals being accessible from the exterior of the switch component chamber;

two removable end caps for covering respective ones of the switch terminals, each of the end caps having a cable aperture for passage of an associated one of the power cables and a first sealing device associated with the cable aperture for sealing around the associated one of the power cables; and two seal rings for engagement between respective end caps and respective ends of the switch housing on engagement between the end caps and the ends of the housing, the two seal rings being interconnected;

whereby the switch housing is fully sealed to protect against the ingress of moisture into the switch component chamber.

2. The switch device as claimed in claim 1 wherein the housing includes a top switch cover and a bottom switch cover and the interconnection between the two seal rings is in the form of two sealing strips engageable between the joints of the top and bottom switch covers.

3. The switch device as claimed claim 2 wherein the seal rings are received in respective sealing seats and the seal rings are effective to releasably hold the top and bottom switch covers together in assembled configuration.

4. The switch device as claimed in claim 1 wherein the switch housing incorporates at least one aperture through which the sealed switch actuator protrudes, the switch actuator being sealed to protect against the ingress of moisture into the switch chamber.

5. The switch device as claimed in claim 1 wherein a residual current device is provided in the switch component chamber.

6. The switch device as claimed in claim 1 wherein a cable grip is disposed within each removable end cap.

* * * * *